US008742994B2

(12) United States Patent
Davies

(10) Patent No.: US 8,742,994 B2
(45) Date of Patent: Jun. 3, 2014

(54) ANTENNA SYSTEM

(75) Inventor: Stuart Davies, Copenhagen (DK)

(73) Assignee: Molex Incorporated, Lisle, IL (US)

( * ) Notice: Subject to any disclaimer, the term of this patent is extended or adjusted under 35 U.S.C. 154(b) by 201 days.

(21) Appl. No.: 13/292,586

(22) Filed: Nov. 9, 2011

(65) Prior Publication Data

US 2012/0139800 A1 Jun. 7, 2012

Related U.S. Application Data

(60) Provisional application No. 61/411,646, filed on Nov. 9, 2010.

(51) Int. Cl.
*H01Q 1/24* (2006.01)

(52) U.S. Cl.
USPC ..... 343/702; 343/748; 343/764

(58) Field of Classification Search
USPC ..... 343/702
See application file for complete search history.

(56) References Cited

U.S. PATENT DOCUMENTS

2004/0224135 A1* 11/2004 Krebs ..... 428/195.1
2008/0261014 A1* 10/2008 McGuire et al. ..... 428/297.1
2010/0049012 A1* 2/2010 Dijksman et al. ..... 600/302

* cited by examiner

*Primary Examiner* — Jerome Jackson, Jr.
*Assistant Examiner* — Andrea Lindgren Baltzel
(74) *Attorney, Agent, or Firm* — Stephen L. Sheldon

(57) ABSTRACT

A housing includes a 3-D composite structure. The structure includes a flex foil. An antenna trace is provided on a first surface of the flex foil. A shield, which may be a sheet, is positioned on the antenna trace. A resin is molded to the first surface, the shield and the antenna trace. The resultant structure allows for a thin-walled design that can communicate efficiently via wireless signals.

17 Claims, 3 Drawing Sheets

ANTENNA SYSTEM

The application claims priority to U.S. Provisional Application No. 61/411,646, filed Nov. 9, 2010, and which is incorporated herein by reference in its entirety.

BACKGROUND OF THE INVENTION

1. Field of the Invention

The present invention relates to field of antennas, more particularly to the field of antennas suitable for use with portable electronic devices.

2. Description of Related Art

The portable electronic device (PED) has increasingly been used to communicate in a wireless manner. One major issue with PEDs is the desire to keep the device small enough to make it easy to carry. Another major issue with PEDs is a desire for an efficient wireless communication system that does not cause the PEDs' battery to drain prematurely. Unfortunately, sometimes these goals are at odds with each other. For example, reducing the size of an antenna in the portable device will tend to decrease the space necessary to package antenna but will also tend to decrease the efficiency and/or effectiveness of the antenna system. Solutions that could help in both areas would be appreciated by users and designers of PEDs.

BRIEF SUMMARY OF THE INVENTION

An antenna trace is provided on a first surface of a flex foil, which may be transparent. The antenna trace can be loop shaped. A shield, which may be a sheet, is positioned on the antenna trace. A resin is molded over the first surface, the RF shield and the antenna trace. The resin can include a via to allow for direct electrical contact with the antenna trace. A second surface of the flex foil can operate as a decorative surface, and a label can be printed on the first surface.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
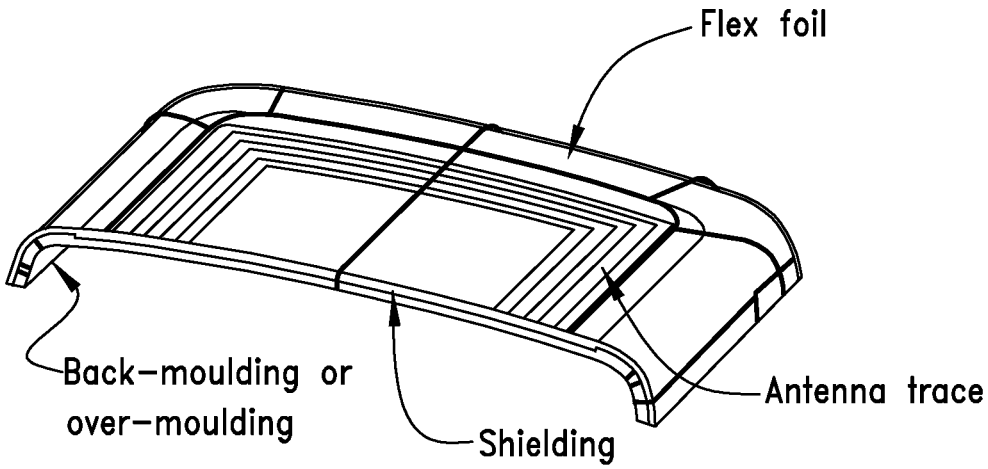
FIG. 1 illustrates a perspective view of a section of an embodiment of a 3-D composite structure that includes an antenna system.
Figure 2:
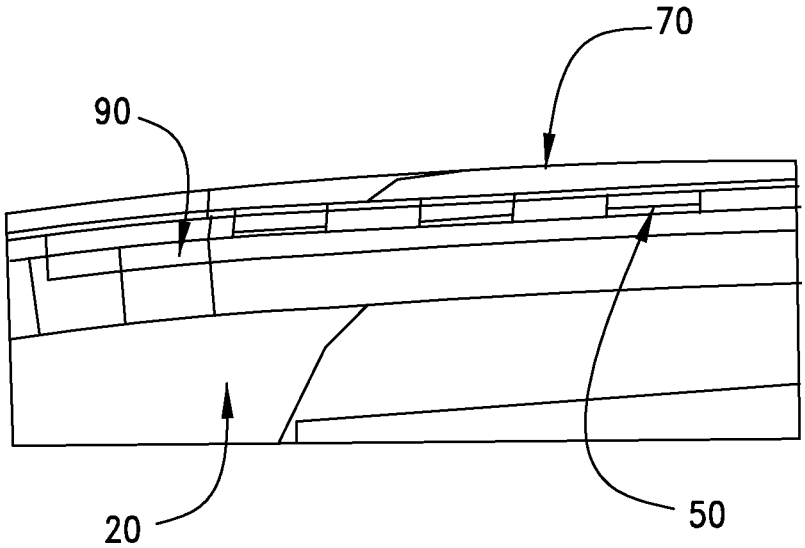
FIG. 2 illustrates a perspective enlarged view of the structure depicted in FIG. 1.

FIGS. 1-2 illustrates a printed antenna layer sandwiched between a flex foil 70 and a back-molded section 20. The flex foil, sometimes referred to as a flex film, supports the antenna trace 50 and in operation the antenna trace 50 can be applied directly to the flex foil. The antenna trace 50 can have a variety of shapes, the shape of which can be appreciated in FIG. 1 due to the fact that the flex foil is depicted as being transparent, and as depicted the antenna trace is loop shaped. A shield 90 can be provided directly against the antenna traces 50. The back-molded section 20 is applied to the flex foil 70 and the shield 90. In an embodiment, as will be discussed below, a label could have been printed on the interior surface of the transparent flex foil and the antenna trace(s) provided on the label. This would tend to make only the label visible through the transparent flex foil. As can be appreciated from FIG. 2, the back-molded section 20 creates a sandwich with the flex foil 70 and that sandwich provides a composite structure that can support a plurality of antenna traces 50 and the shield 90. As can be appreciated, the flex foil 70 can include a curved surface (e.g., can be convex or concave). It should be noted that the back-molded section 20 is provided on the same side of the flex foil 70 as the antenna trace 50 and therefore it may be advantageous to provide one or more vias in the back-molded section 20 so that an electrical connection can be made with the antenna trace 50. It should be noted that while the shield 90 was depicted as a sheet (e.g., continuous between edges of the shield) and as spanning the entire distance between edges of the antenna trace that form the loop, the shield 90 could also be configured to more closely correspond to the profile of the antenna trace (e.g., the center of the shield 90 could be omitted). To obtain more desirable shielding performance, the shield 90 can extend outward of sides of the antenna trace 50.

While the above has the antenna trace depicted as a loop, other antenna configurations are possible and can benefit from the inclusion of the shield. Loop antennas will tend to create magnetic currents and the magnetic currents will cause the generation of eddy currents in nearby metal structures. This tends to reduce the effective inductance of the loop antenna and can cause the antenna system to function less efficiently. Thus, the shield will often be desired when a loop antenna design is used.

Figure 3:
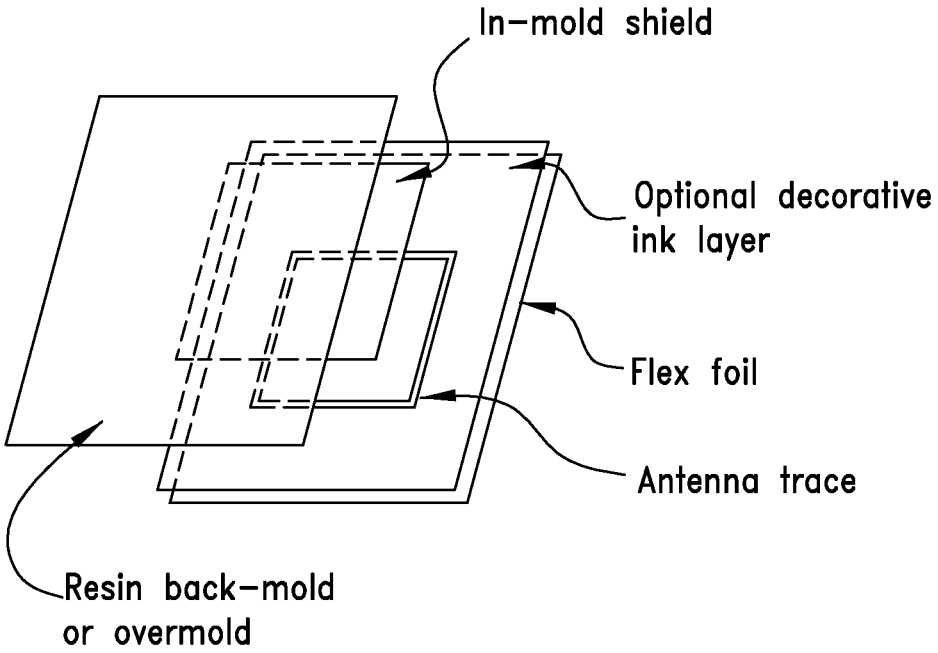
FIG. 3 illustrates a schematic view of an antenna trace, RF shield sheet and a resin layer.

FIG. 3 illustrates a schematic representation of the potential structure that can be provided. A flex foil has a first side, which can provide an exterior surface for the 3-D structure, and can have an optional decorative label on a second side and includes an antenna trace on the second side (if the decorative label is provided, then antenna trace can be positioned on the decorative label). A shield, which is depicted as a sheet, is positioned on the antenna trace to provide magnetic shielding and a resin is back-molded over the shield onto the flex foil so as to provide a composite structure capable of supporting the antenna trace in a desired location (e.g., the composite structure can form part of a housing suitable for use in a PED).

Figure 4:
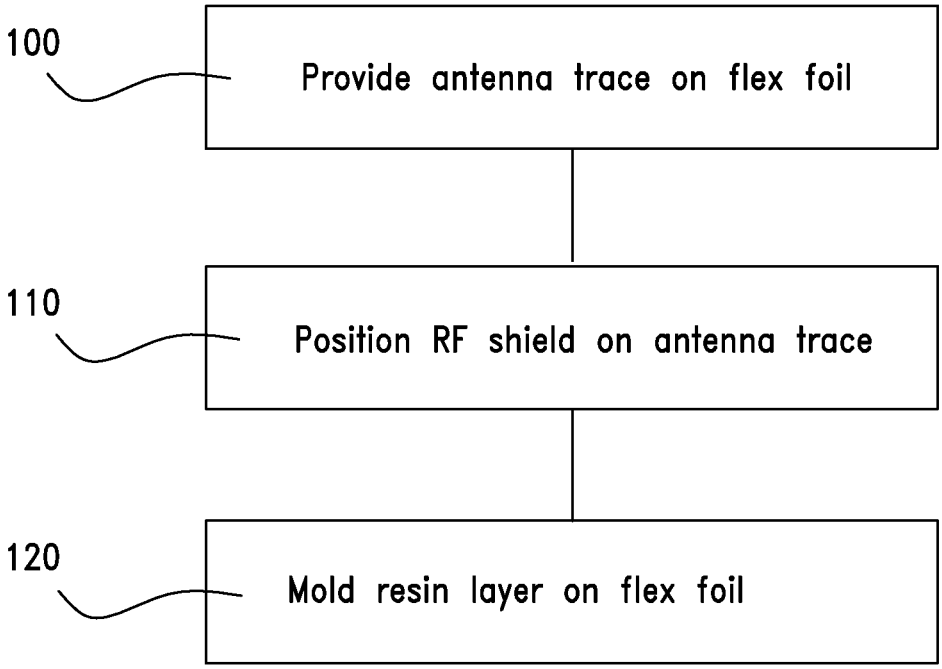
FIG. 4 illustrates an exemplary method of forming an antenna system.

FIG. 4 illustrates a method of forming such a composite structure. In step 100, an antenna trace (which as noted above can be a loop antenna) is provided on a flex foil. If desired, the flex foil can be shaped into a desired three-dimensional structure. In step 110, the RF shield is positioned on the flex foil and the antenna trace. The RF shield can include an adhesive layer to help it to stick to the flex foil and if so provided, adhesive layer may be configured to withstand the injection pressure and temperature that takes place during the over-molding process. In step 120, the resin is back-molded onto the flex foil and the in-mold shield (which as noted, may be a sheet or have some other appropriate shape suitable for providing the desired shielding). In practice, as noted below, it is often beneficial to allow for a direct electrical connection to the antenna trace.

The shield can be configured to be slightly larger than the size of the antenna loop. For example, without limitation, if the shield is a sheet then it could extend 1 mm beyond the outer edge of the antenna loop. The shield can be configured to have a thickness of between 100 and 200 μm (the minimum thickness is generally dictated by the desired level of shielding). If the flex foil has a minimal thickness, and the desired wall thickness of the composite structure is about 0.8 mm, then it may be preferable to keep the thickness of the shield at or below 0.2 mm so that there is sufficient room for the resin to flow during the over-molding process.

If the flex foil is being used to provide a external decorative surface and the resin is molded on an internal side of the flex foil, then the shield may be positioned directly on the antenna trace (on the internal side). As can be appreciated, some magnetic materials are somewhat conductive and it is generally undesirable to place such materials directly on the loop antenna. It has been determined that if the shield uses a ferrite material such as iron powder in ceramic (e.g., TDK Corporation's TDK IBF10), the high surface resistivity of the shield will cause the shield to be effectively nonconductive, thus minimizing the impact on the inductance of the antenna loop.

Figure 5:
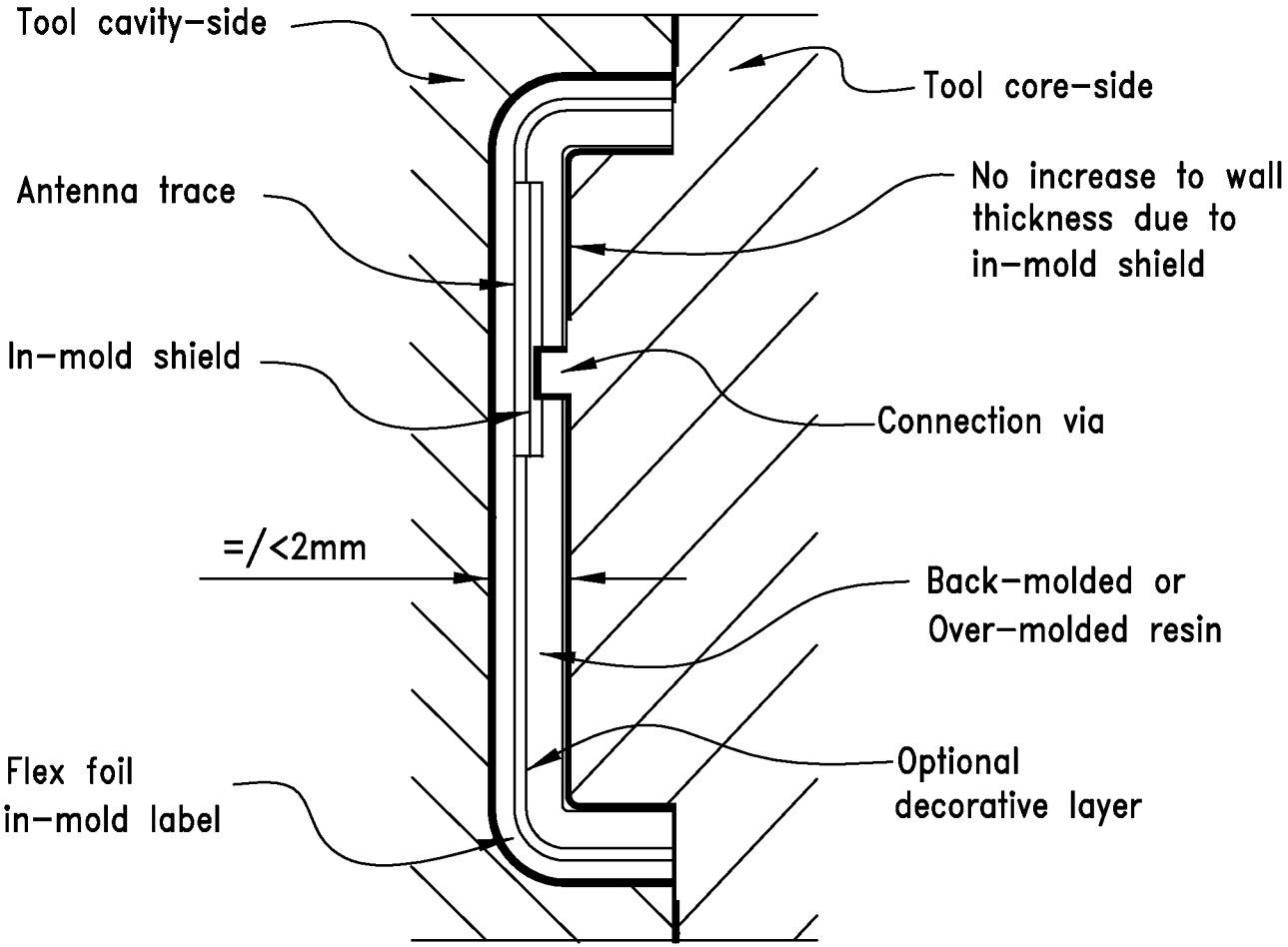
FIG. 5 illustrates an exemplary representation of a part being formed.

FIG. 5 illustrates forming a 3-D composite structure that includes a flex foil with a decorative label, an antenna trace on a second surface, a shield positioned directly on the antenna trace, and a resin molded over the non-decorative surface of the flex foil. As can be appreciated, the total thickness of the 3-D composites structure can be less than 2 mm and in many embodiments, it will not be necessary to increase the wall thickness of the resultant structure due to the in-mold shield. In an embodiment, the mold used to form the structure can provide a via in the resin so that in electrical connection to the antenna trace can be easily made. As can be appreciated, the shield may also include a via so that electrical connection can be made directly with antenna trace. However, if the shield is formed so that it has more of a loop shape, it may be that a portion of the antenna trace is not covered by the shield and no via would be required through the shield. It should be noted that while the external surface of the flex foil is depicted as being convex, in an alternative embodiment the flex foil's exterior could be concave or some other shape as desired and a corresponding decorative label (as well as the resin over-mold) would be shaped accordingly. Thus, the depicted shape of the tool core-side and tool cavity-side is not required.

As can be appreciated from the depicted embodiments, in practice the shield captures the magnetic currents and diverts these currents way from other metal structures provided in the portable device. This helps preserve RF signal strength, thus allowing both a thin-walled molding structure and an effective RF communication. For an example, but without limitation, Near-Field Communication (NFC) at 13.56 MHz and communication at FM radio frequencies, such as about 87 MHz to 108 MHz could benefit from the depicted structure. Consequently, the use of a structure such as depicted in FIG. 5 allows for a design that has high level of component integration and is suitable for use in PED applications where space is at a premium. It should be noted that the depicted antenna structure is not limited to use in PEDs and it is contemplated that a structure such as is disclosed could also be provided in a housing a device that was not considered portable.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

I claim:

1. An antenna system, comprising:
a flex foil with an exterior and interior surface;
an antenna trace provided on the interior surface;
a shield mounted on the antenna trace; and
a resin molded onto the interior surface, the resin at least partially covering the antenna trace and the shield, wherein the shield is sized to extend at least 1 mm beyond the outer edge of the antenna trace.

2. The antenna system of claim 1, wherein the antenna trace has a loop shape.

3. The antenna system of claim 2, wherein the shield is loop shaped.

4. The system of claim 2, wherein the shield is a sheet.

5. The antenna system of claim 1, wherein the flex foil is transparent.

6. The antenna system of claim 4, further comprising a printed label provided on the interior surface.

7. An antenna system, comprising:
a flex foil with an exterior and interior surface;
an antenna trace provided on the interior surface;
a shield mounted on the antenna trace; and
a resin molded onto the interior surface, the resin at least partially covering the antenna trace and the shield, wherein the resin provides a second interior surface and the shield is positioned closer to the second interior surface than the antenna trace.

8. The antenna system of claim 7, wherein the second interior surface is concave.

9. The antenna system of claim 8, wherein the shield is sized to cover the antenna trace.

10. The antenna system of claim 9, wherein the resin includes a via configured to allow for direct electrical contact with the antenna trace.

11. An antenna system, comprising:
a flex foil with an exterior and interior surface;
an antenna trace provided on the interior surface;
a shield mounted on the antenna trace; and
a resin molded onto the interior surface, the resin at least partially covering the antenna trace and the shield, wherein the shield is a ferrite material in a ceramic material.

12. A method of forming an antenna system, comprising:
providing a flex foil;
positioning an antenna trace on the flex foil;
aligning a shield with the antenna trace; and
forming a resin over the shield and the flex foil, wherein the resin and the wall form a structure suitable for use as a housing, wherein the forming of the resin creates a concave sham with an interior surface and the shield is positioned closer to the interior surface than the antenna.

13. The method of claim 12, wherein the forming of the resin is a back-molding process.

14. The method of claim 12, wherein the forming of the resin is an over-molding process.

15. The method of claim 12, wherein the flex foil is transparent.

16. The method of claim 15, further comprising positioning a decorative layer on the flex foil.

17. The method of claim 15, wherein the antenna trace is positioned directly on the decorative layer.

* * * * *